US005517084A

United States Patent [19]

Leung

[11] Patent Number: 5,517,084

[45] Date of Patent: May 14, 1996

[54] SELECTIVE ION SOURCE

[75] Inventor: Ka-Ngo Leung, Hercules, Calif.

[73] Assignee: The Regents, University of California, Oakland, Calif.

[21] Appl. No.: 280,273

[22] Filed: Jul. 26, 1994

[51] Int. Cl.[6] ..... H05H 1/46

[52] U.S. Cl. ..... 315/111.81; 315/111.21; 315/111.41

[58] Field of Search ..... 315/111.71, 111.81, 315/111.21, 111.31, 111.41; 250/492.21, 424, 427

[56] References Cited

U.S. PATENT DOCUMENTS

| | | | |
|---|---|---|---|
| 4,447,732 | 5/1984 | Leung et al. | 315/111.81 |
| 4,977,352 | 12/1990 | Williamson | 315/111.81 |
| 5,306,922 | 4/1994 | O'Connor | 250/492.21 |

*Primary Examiner*—Benny T. Lee
*Assistant Examiner*—David Vu
*Attorney, Agent, or Firm*—Paul R. Martin; Pepi Ross

[57] ABSTRACT

A ion source is described wherein selected ions maybe extracted to the exclusion of unwanted ion species of higher ionization potential. Also described is a method of producing selected ions from a compound, such as $P^+$ from $PH_3$. The invention comprises a plasma chamber, an electron source, a means for introducing a gas to be ionized by electrons from the electron source, means for limiting electron energy from the electron source to a value between the ionization energy of the selected ion species and the greater ionization energy of an unwanted ion specie, and means for extracting the target ion specie from the plasma chamber. In one embodiment, the electrons are generated in a plasma cathode chamber immediately adjacent to the plasma chamber. A small extractor draws the electrons from the plasma cathode chamber into the relatively positive plasma chamber. The energy of the electrons extracted in this manner is easily controlled. The invention is particularly useful for doping silicon with $P^+$, $AS^+$, and $B^+$ without the problematic presence of hydrogen, helium, water, or carbon oxide ions. Doped silicon is important for manufacture of semiconductors and semiconductor devices.

27 Claims, 4 Drawing Sheets

SELECTIVE ION SOURCE

BACKGROUND OF THE INVENTION

This invention was made with U.S. Government support under Contract No. DE-AC03-76SF00098 between the U.S. Department of Energy and the University of California for the operation of Lawrence Berkeley Laboratory. The U.S. Government may have certain rights in this invention.

1. Field of the Invention

This invention relates generally to ion sources and plasma sources, and generation of ions for ion beams and ion implantation.

2. Description of Related Art

Thin film transistors (TFTs) are constructed using silicon that is doped to exhibit positive valence (p doped or p-silicon). The silicon is doped by implanting phosphorous ions ($P^+$), arsenic ions ($As^+$), or boron ions ($B^+$) in the silicon. Typically the ions are obtained from the starting compounds, $PH_3$, $ASH_3$, and $B_2H_6$, diluted with $H_2$ or He gas. Those starting gaseous compounds are bombarded with high energy electrons in an ionization chamber. The electrons break the bonds of the compounds and ionize the atomic species. Depending upon the starting compound used, the $P^+$, $As^+$ , or $B^+$ is drawn out of the ionization chamber by a negatively biased extractor electrode, mass separated, and directed in a beam to the silicon for implantation. A comprehensive discussion of ion and plasma sources for use in ion implantation can be found in *Handbook of Ion Implantation Technology*, (North-Holland Elsevier Science Publishers B.V., Sara Burgerhartstraat 25, P.O. Box 211, 1000 AE Amsterdam, The Netherlands, 1992), Edited by J. F. Ziegler.

One problem with doping silicon with the three above compounds is that a high concentration of unwanted positive ions are generally implanted along with the dopant ion. Hydrogen is the main unwanted positive ion ($H^+$ or $H_2^+$) that is extracted with the dopant ion. The impact of the unwanted ions causes problematic heat loading at the target surface, resulting in defects in the target and making it difficult to use low temperature photoresists. Implantation of many unwanted positive ions also imparts a positive charge to the target which can change the implant energy and implant profile of the desired dopant ion. Additionally, unwanted $H^+$ or $H_2^+$ doping of the target silicon produces transistors with poor performance characteristics; Hydrogen ion implantation in the silicon crystal causes crystal lattice defects and trapping centers that interfere with performance.

H. Itoh et al. (U.S. Pat. No. 4,533,831; "Non-Mass-Analyzed Ion Implantation", by H. Itoh; K. Tokiguchi, T. Warabisako, and T. Tokuyama) describe an ion implantation process wherein a magnetic field is applied in a direction transverse to the traveling direction of the ion beam. In that configuration, ions are dispersed, according to their charge-to-mass ratios (q/m), by Lorentz forces in a direction that is vertical to both the traveling and magnetic field directions. An ion with lower mass will be more diverted from its path than an ion with higher mass of the same charge. It is thus possible to configure the magnetic field so that the percentage of relatively large-mass ions increases in the central area of scanning whereas the percentage of relatively small-mass ions increases at the periphery of scanning. Two or more species of ions of the same polarity having greatly different ion masses are implanted with a distribution profile that varies with the mass of the ion. When ions are implanted onto an area larger than the beam spot size containing the higher concentration of ions of choice, the beam and the substrate must be rastered in orthogonal directions. Rastering the beam and substrate is complex and cumbersome and is limited in scope. The size of the substrate to be implanted is eventually limited by the region in which higher mass ions can be concentrated. Removal of hydrogen ions in this region is incomplete, particularly if a carrier gas of $H_2$ is used, as is commonly the case. It would be very advantageous to generate a pure $P^+$, $As^+$, or $B^+$ beam so that an extra magnetic field need not be applied transverse the path of the ion beam. It would also be desirable to be able to implant a beam free of contaminating hydrogen ions without the need to raster either the beam or the substrate. A further advantage would be an ion source where the spot size of the beam could manipulated independently of contaminating hydrogen ions.

Masayasu Tanjyo and colleagues have limited the effect of unwanted $H^+$ or $H_2^+$ doping by installing a mass separation device in the extraction electrodes of the ion source (U.S. Pat. No. 5,189,303: "Ion Source having a Mass Separation Device". M. Tanjyo and H. Nakazato; and "Impurity Doping for LCD-TFT by Ion Shower System With Rough Mass Separation", by M. Tanjyo, N. Miyamoto, and J. Fujita, *Japan Display* '92, pgs. 345–348). In these two documents, Tanjyo and colleagues describe adapting a Wien filter, which uses crossed electric and magnetic fields, to separate the relatively low mass hydrogen ions from the ion beam incident on the target. Tanjyo's rough mass separation system, which uses "many Wien filters installed at all the holes of the extraction electrode plate" (U.S. Pat. No. 5,189,303) is difficult to build, has low resolution, and can generate unwanted particles when the low-mass ions hit the extraction and filter electrodes after separation from the beam. To suppress such parasitic discharge, Tanjyo increases the complexity of the extraction electrode and filter design and adds extra electrodes to teach an assembly of up to 6 electrode plates. It would be a great advantage and of great utility to have a pure $P^+$, $As^+$, $B^+$ ion source that did not need complicated filters or extraction electrodes.

A. J. Armini describes an ion source that does not require use of dangerous phosphine or arsine gas (U.S. Pat. No. 5,309,064; "Ion Source Generator Auxiliary Device"). The ion source has an auxiliary chamber attached to and in communication with the plasma or arc chamber. The auxiliary chamber contains chips of barium, calcium or cerium. Pentafluorides $PF_5$ and $AsF_5$, available as convenient bottled gases, provide the source of arsenic and phosphorous. The metal chips, placed in the auxiliary chamber react with the incoming pentafluorides at 500° C. to liberate free arsenic or phosphorous. It is the free arsenic or phosphorous gas that enters the arc chamber, ideally as a pure element. Under ideal operation, a system like Armini's would eliminate contamination from unwanted hydrogen ions as well as protecting the user from dangerous phosphine and arsine gasses. Because of the larger mass of fluorine, unwanted contamination of the beam with fluorine ions is even more damaging than hydrogen ion contamination. In Armini's experiments, unfortunately, 47% of the extracted beam comprised extraneous fluorine-containing compounds (FIG. 5 of '064) which would poison the silicon substrate with fluorine at a level unacceptable for most purposes. It would be of very great benefit to have an arsenic and phosphorous ion system that was free of both unwanted hydrogen ions and unwanted fluorine ions.

Co-pending application Ser. No. 08/225,043, *Pulsed Source Ion Implantation Apparatus & Method*, describes a method and apparatus for implanting a target within the plasma chamber. It would be additionally advantageous if, instead of extracting ions for implantation, the implant target could be placed inside the plasma chamber and biased to accelerate only selective ions into it.

SUMMARY OF THE INVENTION

The present invention comprises a plasma ion source of boron, arsenic, or phosphorous that is essentially free of unwanted hydrogen ions. In addition, impurity ions such as $CO^+$, $CO_2^+$, and $H_2O^+$ are not generated. The ion source comprises an ion generating chamber, an electron source, means for introducing a gas comprising target specie(s) into the plasma chamber—that gas to be ionized by electrons from the electron source, means for limiting electron energy from the electron source to a value between the ionization energy of a target ion species and the greater ionization energy of unwanted ion specie(s), and, if desired, means for extracting the target ion specie from the ionization or plasma chamber. For example, since the ionization potential of hydrogen is more than about 16 eV and the ionization potential of phosphine and phosphorous is about 10 eV to about 10.5 eV, primary ionizing electrons with an energy of about 12 eV will not generate hydrogen ions but will ionize phosphine and phosphorous. As a result, the extracted beam will be essentially free of hydrogen ions, and will be comprised essentially entirely of ions of $P^+$, $PH^+$, $PH_2^+$, and $PH_3^+$.

The limited-energy electrons used to create the plasma can be generated by a number of conventional techniques and materials such as tungsten filament, a variety of cathode materials (for example $LaB_6$), radio frequency (RF) induction, or microwave and electron cyclotron resonance (ECR) techniques. Alternately, primary ionizing electrons can be induced in a chamber adjacent to the ionization chamber and extracted at the appropriate energy into the plasma chamber.

The inventive ion chamber is particularly useful for positive doping of silicon to manufacture semiconductors and semiconductor devices.

SUMMARY DESCRIPTION OF THE DRAWINGS

DETAILED DESCRIPTION OF THE INVENTION

The invention comprises an ion source characterized by limited-energy primary ionizing electrons to create plasma ions. The ion source is capable of generating ions of a desired species without generating unwanted ions which are characterized by a higher ionization potential, such as hydrogen.

By use of the term "plasma source" herein is meant a device that produces a highly ionized gas which contains approximately equal numbers of positive and negative free charges (e.g. ions and electrons). The plasma source is also an ion source.

By use of the term "plasma cathode" is meant a cathode in which the source of electrons is a gas plasma rather than a solid.

By use of the term "plasma chamber" is meant a chamber in which the target species are ionized by collision with ionizing electrons prior to extraction. In the general literature, the terms ion source chamber or plasma source chamber may be used interchangeably with plasma chamber. Typically the extracted ions of a selected ion species is used for implantation into a target substrate.

By use of the term "ionizing electrons" herein is meant the electrons in the ionization chamber which cause charged and uncharged molecules to ionize, thus creating a plasma. When a DC arc discharge is used as the source of ionizing electrons, the high energy electrons generated by the arc discharge are termed "primary ionizing electrons".

By use of the term "target specie(s)" is meant the ion species and it's predecessor molecule(s) or atom(s) that are selected to be implanted in the substrate, thus the invention name, "Selective Ion Source". The "target ion specie" is the ion formed from the selected target specie.

The selective ion source of the invention comprises a plasma chamber, means for generating ionizing electrons, means for introducing a gas comprising target specie(s) into the plasma chamber—that gas to be ionized by electrons from the electron source, means for limiting electron energy from the electron source to a value between the ionization energy of a target ion species and the greater ionization energy of an unwanted ion specie, and optionally means for extracting the target ion specie from the plasma chamber. In one embodiment, the electrons will be generated in a plasma cathode chamber immediately adjacent to the plasma chamber. A small extractor draws the electrons from the plasma cathode chamber into the relatively positive plasma chamber. The energy of the electrons extracted in this manner is easily controlled.

a. Plasma Electron Energy

Figure 1:
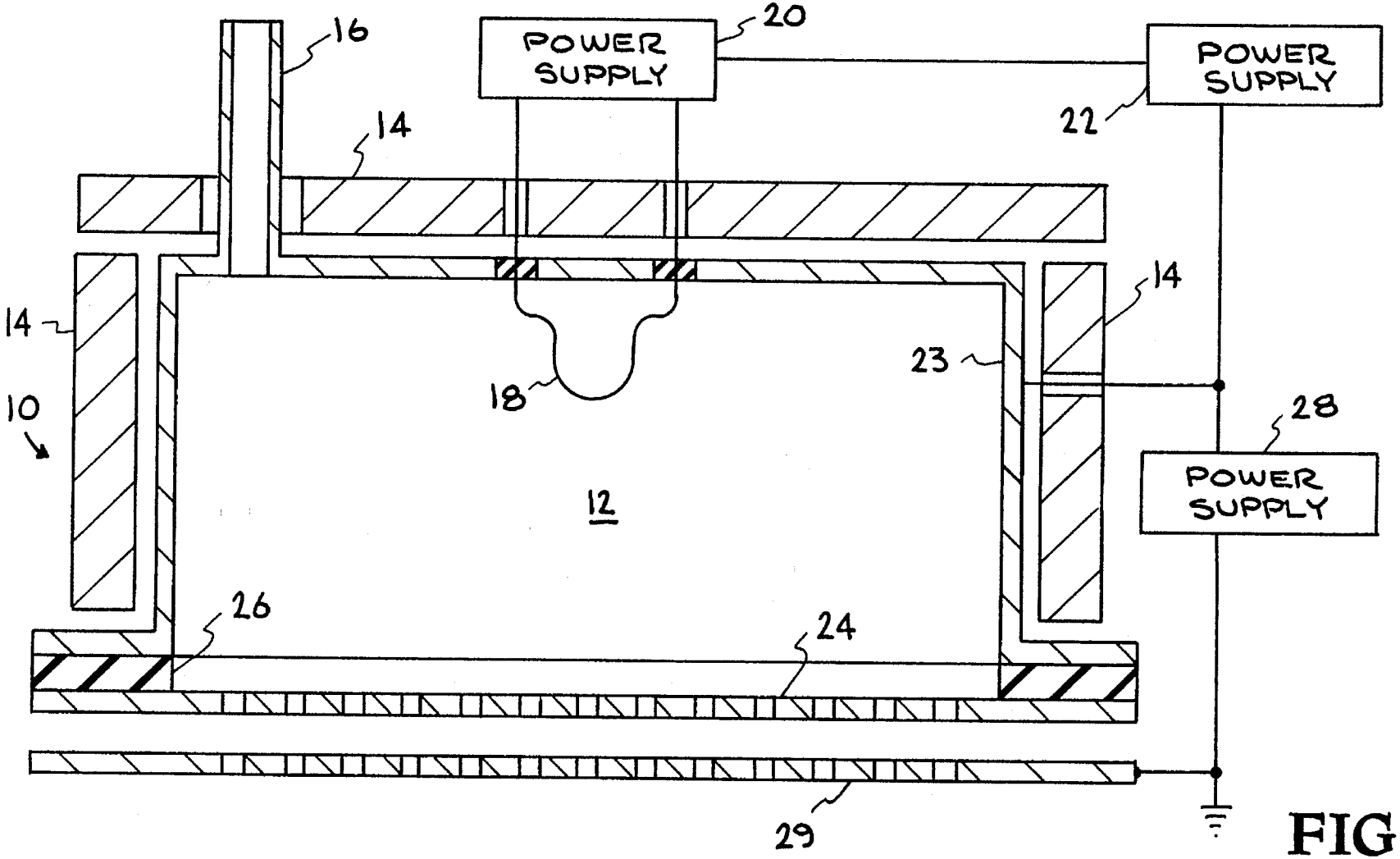
FIG. 1 is a schematic representation, partially in cross section, of an ion source that can be used to practice the invention.

Referring now to the drawings, FIG. 1 shows a schematic representation of an ion source, 10. The ion source has a plasma chamber 12 that may be formed from, for example, a copper cylinder. There are many types of ion source and plasma source chambers, many of which can be used in practicing the present invention. The plasma chamber is surrounded by permanent magnets 14 which confine the plasma in a quiescent state with a uniform plasma density profile. After creating a vacuum in the plasma chamber, the gas to be ionized, for example phosphine diluted 5:95 with $H_2$ or He, enters the chamber at inlet tube 16. A phosphine plasma is generated by the ionizing effect of primary ionizing electrons emitted from a tungsten filament 18. Power source 20 heats the filament 18 and power source 22 maintains the electrical potential at the inner surfaces of the plasma chamber such that they serve as the anode for the filament. More than one filament can be used, as is described in U.S. Pat. No. 4,486,665. In the past, primary ionizing electrons having about 80 eV energy were used to ionize both the hydrogen and the phosphine.

In the present invention plasma electron energy is limited to a value greater than that needed to ionize the dopant gas compound but less than that needed to ionize hydrogen or other unwanted species such as He, CO, $CO_2$, or $H_2O$. For example, because the ionization energy of elemental hydrogen, H, and molecular hydrogen, $H_2$, is 13.6 eV and 16 eV respectively, and the ionization energy of elemental phosphorous, P, and molecular phosphine, $PH_3$ is 10.5 eV and 10 eV respectively, primary ionizing electrons having energy between 10.5 and 13.5 eV will ionize P and $PH_3$ but will not ionize H, or $H_2$.

The reactions for phosphine gas in the presence of, for example, electrons of about 12 eV include:

$PH_3+e^-\rightarrow PH_3^++2e^-$;

$PH_3+e^-\rightarrow PH_2+H+e^-$;

$PH_2+e^-\rightarrow PH_2^++2e^-$;

$PH_2+e^-\rightarrow PH+H+e^-$;

$PH+e^-\rightarrow PH^++2e^-$;

$PH+e^-\rightarrow P+H+e^-$;

$PH+e^-\rightarrow P+H^++2e^-$;

$PH+e^-\rightarrow P^++H+2e^-$; and $P+e^-\rightarrow P^++2e^-$.

In this example, the plasma in the chamber 12 comprises $PH_3^+$, $PH_2^+$, $PH^+$, $P^+$, and $e^-$ where the electrons have energy of about 12 eV or less. Ions of the target specie were extracted from the plasma chamber by grounding the extractor electrode 29 and biasing the plasma chamber wall at about 150 volts positive with respect to ground using a Power Ten DC power supply 28. The plasma chamber 12 is electrically insulated from extractor electrode 24 by use of any of a large number of insulating materials generally commercially available 26. For example, mylar sheets, machinable glass, ceramics, rubbers, non-conducting polymers, or other non-conducting materials can be used. Because biasing the first extractor electrode 24 at a high potential would generate undesirable secondary electrons, extractor electrode 24 is allowed to float a few volts above the potential of the plasma. Extraction electrode 29, which is negative with respect to the plasma, extracts the positive $PH_3^+$, $PH_2^+$, $PH^+$, and $P^+$ for acceleration to the target substrate. More than two extraction electrodes may be used in the accelerator column to achieve the desired ion beam optics.

b. The electron source

There are many generally known ways of generating primary ionizing electrons for this invention. They are comprised primarily by two categories, direct current (DC) discharge and alternating current (AC) discharge. DC discharge cathodes commonly include tungsten, tantalum, metal oxide, carbon, and lanthanum hexaboride filaments, although other cathode materials can also be used. AC discharge cathodes commonly include radio frequency (RF) induction, microwave, ECR, or laser cathode, although other ac sources can be used. Use of the above electron sources in plasma and ion sources are generally described in the literature, for example in J. F. Ziegler's Handbook of Ion Implantation Technology, North-Holland Press, 1992.

DC discharge cathodes give rise to primary ionizing electrons with energy approximately equal to the voltage applied between the filament and the anode. There are many ways to apply the voltage. In FIG. 1, a power supply 22 applies a voltage between the cathode (filament) 18 and the anode 23. In this case the inner wall of the plasma chamber is used as an anode. The value of the voltage applied between the filament (cathode) and anode determines the energy of the primary ionizing electrons pulled off the filament. If the filament power supply 20 is biased as shown in FIG. 1, with its negative terminal in common with the negative pole of 22, the highest potential between the filament 18 and anode 23 is determined by the voltage of power supply 22.

Primary ionizing electrons will loose energy as they collide with target compounds and ionize them. After a few collisions, the ionizing electrons will no longer have enough energy to ionize the background gas particles; these electron then merge with and augment the background low energy (1 eV to 2 eV) plasma electrons.

AC sources can also be used. The energy of the electrons is controlled by the amount of power applied to the ac source. However, typically there is a wider spectrum of energies in the ionizing electrons when an ac source is placed directly in the plasma source.

Figure 2:
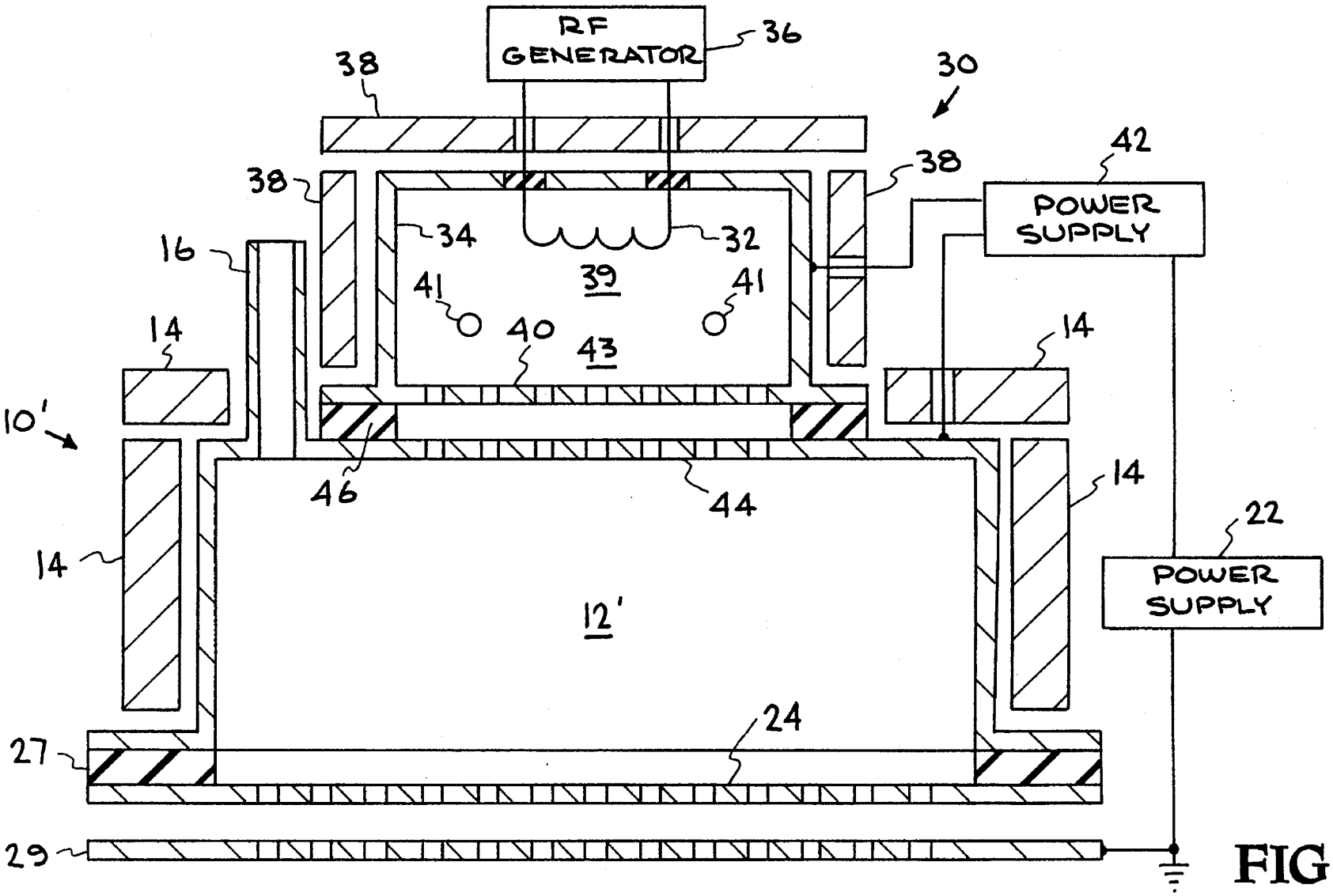
FIG. 2 is a schematic representation, partially in cross section, of an alternate ion source that can be used to practice the invention.

A plasma cathode can also be used as a source of primary ionizing electrons in the inventive ion source. FIG. 2 schematically illustrates the inventive plasma ion source configured with a plasma cathode 30. Use of a plasma cathode provides primary ionizing electrons with a high degree of energy homogeneity. Additionally, the plasma cathode provides a cleaner source of electrons since filament material that evaporates or is sputtered from the filament is retained in the plasma cathode chamber. FIG. 2 shows an RF antenna 32 that generates electrons by inductively coupling RF energy into plasma cathode volume 31. RF antennas are long lived and generate clean plasma. A particularly long-lived, porcelain-coated RF antenna is described in pending application Ser. No. 08/010,108, incorporated in its entirety herein by reference. The antenna is powered by RF generating circuitry 36, a description of which is generally available in the literature (Leung, K. N. et al. Nuclear Instruments and Methods in Physics Research, B74 (1993) 291–294,).

The plasma is confined in the plasma cathode internal volume by magnets 38. A multicusp configuration, described in U.S. Pat. No. 5,198,677, *Production Of N+ Ions From A Multicusp Ion Beam Apparatus* would provide particularly high efficiency.

The plasma cathode chamber is electrically insulated from the plasma chamber 12' by use of any of a large number of insulating materials generally commercially available 46. For example, mylar sheets, machinable glass, ceramics, rubbers, non-conducting polymers, or other non-conducting materials can be used. Plasma cathode chamber exit wall 40 has holes through which electrons can exit. Power supply 42 biases extraction electrode 44, which in turn connects the plasma cathode 30 to the plasma chamber 12'. When gas is let into the plasma chamber via gas inlet 16, it diffuses from the plasma chamber 12' through extraction electrode 44 and exit wall 40 to fill the plasma cathode 30.

Electrons with sufficient energy to ionize the background gas are produced in the center of the volume enclosed by the helical antenna 32. The primary electrons quickly loose energy in collisions with the surrounding gas and form a background of about 1 eV to about 2 eV electrons. A bias voltage of about −12 Volts is applied between the wall of the plasma cathode chamber and the extraction electrode 44. This imparts a uniform energy of about 12 eV to the electrons that enter the plasma chamber 12'. The extracted electron current from the plasma cathode into the plasma chamber 12', is increased by enlarging the extraction area.

Any of the DC discharge cathodes or AC electron sources can be placed directly in the plasma ion source or used in a plasma cathode. The AC sources are more suited in general for plasma cathodes because it is difficult to control the upper limit of ionizing electron energy. When an AC source is used in the main plasma chamber of the inventive ion source, it must be operated at relatively low power, ranging from about 500 watts to about 1,000 watts. These power levels may result in a low current ion beam that is unsuitable for some purposes. On the other hand, when the ac electron sources are used in a plasma cathode, the lower energy background electrons in the plasma cathode can be accelerated into the plasma ion source chamber using the voltage or power supply 42 that will confer a controllable uniform energy on them. DC discharge cathodes are better suited than AC electron sources for use directly in the plasma source because primary electrons can be pulled off the filament at an energy controlled by voltage or power supply 22. One disadvantage of locating a DC discharge cathode in the plasma source chamber is that cathode material evaporates into the plasma volume and becomes a source of impurities. This disadvantage can be avoided by placing the DC discharge cathode in a plasma cathode.

c. Means for controlling plasma electron energy

Referring now to FIG. 1, the energy of primary ionizing electrons from a tungsten filament 18 is limited by limiting the arc voltage via power supply 22. For example to maintain a ionizing electron energy of 12 volts or less, arc power supply 22 would be set to apply a bias of 12 volts between the filament and the plasma chamber walls. Power supply 20 used to control the electron emission current from the tungsten filament, can be set at any of a large range of voltages, for example from about 5 volts to about 20 volts, depending on the diameter of the tungsten filament used. Typically it would be adjusted to about 10 volts.

When an RF antenna is used in place of the tungsten filament without using a plasma cathode, that is in the configuration illustrated in FIG. 1, only about 500 Watts is used at about 2 MHz. The power must be kept low to keep the average electron energy low.

When a plasma cathode is used, as illustrated in FIG. 2, an RF power setting of about 500 W to 1 kW is used for an RF antenna.

Both types of electron sources, DC arc discharge, and AC induction can be used in the configuration illustrated in FIG. 1 or in a plasma cathode as illustrated in FIG. 2. When placed in the plasma chamber 12 as illustrated in FIG. 1, the DC source tends to introduce impurities from the filament into the plasma; for an ac source it is difficult to control the maximum energy of the ionizing electrons. Thus there are reasons why it is preferable to locate either a DC or an AC source in a plasma cathode and extract ionizing electrons of uniform energy from the plasma cathode into the plasma chamber 12. The plasma cathode 30 provides essentially pure electrons of uniform energy to the plasma chamber 12'.

When using the plasma cathode care must be exercised to limit the energy of electrons that enter the plasma chamber 12'. For example, when a DC filament is used in the plasma cathode, a primary electron with 12 eV energy could be immediately extracted into the plasma chamber by the voltage gradient imposed by power supply 42, perhaps another 12 volts. That scenario would give the ionizing electron a total of 24 eV, too much for selective ionization of, say, phosphine in the presence of hydrogen. To prevent energetic electrons from being extracted to the plasma chamber, magnetic filter rods 41 are placed in the plasma cathode volume near the extraction electrodes as described in the article, *Extraction of volume-produced $H^-$ ions from a multicusp source*, by K. N. Leung, K. W. Ehlers, and M. Bacal, *Rev. of Sci Instrum.* 54:56–61(1983) and in U.S. Pat. No. 4,447,732. The magnetic field resulting from one or more of these magnetic rods acts as a magnetic filter. The magnetic rods generate a thin transverse magnetic field with magnitude ranging from 40 gauss to 200 gauss. The transverse magnetic field divides the plasma cathode into a "source region" 39 on the electron source side of the magnetic filter, and an "extraction region" 43 on the extraction side of the magnetic filter. The magnetic filter field is strong enough to reflect essentially all of the energetic electrons but is weak enough to enable low energy plasma ions and low energy electrons to diffuse through it. Only a cold plasma with a very low electron temperature is found in the extraction region of the plasma cathode. The electric potential of the plasma is about 2 volts greater than the first plasma cathode extraction electrode 40. The second extraction electrode 44 can then be biased at the appropriate potential, for example 12 volts positive with respect to the first electrode, then the energy of the electrons extracted into the plasma chamber 12' will be about 12 eV. It should be noted that the plasma in the plasma chamber also floats electrically at about 2 volts above the potential of the plasma chamber walls. For simplicity of design, two filter rods could be used, however any number that provides an adequate magnetic filter field may be employed.

If an AC electron source is used in the plasma cathode, using the filter rods in addition enables the practitioner to apply higher power RF power settings, up to 10 kW. The ionizing electrons can thus be generated at high energies which is more efficient than low wattage inductive coupling. The magnetic filter reflects high energy electrons into the source region of the plasma cathode and allows essentially only cold plasma to diffuse into the extraction region of the plasma cathode. Thus the energy of the ionizing electrons that enter the plasma chamber 12' is controlled by voltage source 42.

e. Ions

Many gas compounds can be selectively ionized using the inventive ion source. Table 1 shows the ionization energies of elements and molecules associated with arsine, diborane, and phosphine gases.

TABLE 1

IONIZATION ENERGY OF ELEMENTS AND MOLECULES

| Compound | Ionizt'n Pot. |
|---|---|
| Arsine | |
| $AsH_3$ | 10 eV |
| As | 9.8 eV |
| Diborane | |
| $B_2H_6$ | 12 eV |
| B | 8.3 eV |
| Carbon Oxides | |
| CO | 14.1 |
| $CO_2$ | 14.4 |
| Phosphine | |
| $PH_3$ | 10 eV |
| P | 10.5 eV |
| Hydrogen | |
| H | 13.6 eV |
| $H_2$ | 16 eV |
| Water | |
| $H_2O$ | 12.56 |
| Helium | |
| He | 24.5 eV |

Arsine and diborane comprise gasses of particular interest for use in this invention because they are important ions for doping silicon. However in any compound where the elements have different ionization potentials, the element with the lower ionization potential can be selectively ionized using the present inventive ion source.

Figure 3A:
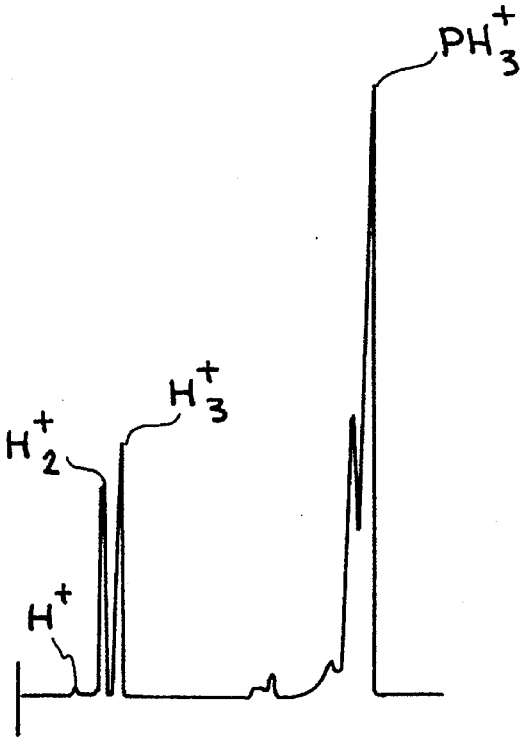
FIG. 3A is a graph of an ion spectrum produced by an ion beam extracted from a conventional ion source operating with a mixture of 5% $PH_3$ and 95% $H_2$.
Figure 3B:
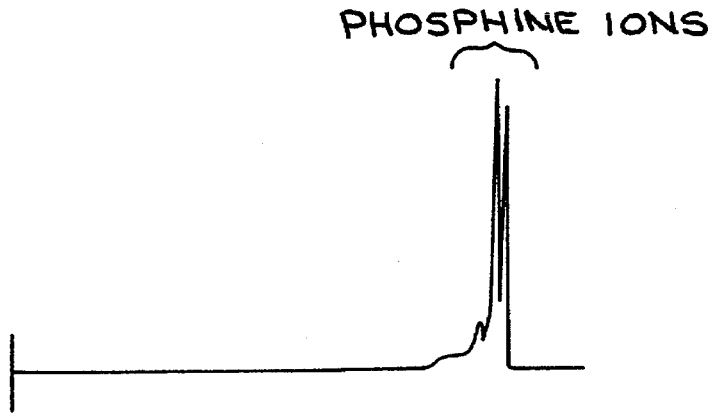
FIG. 3B is a graph of an ion spectrum produced by an ion beam extracted from the inventive plasma ion source operating with a mixture of 5% $PH_3$ and 95% $H_2$ and primary ionizing electron energy limited to 16 eV.
Figure 3C:
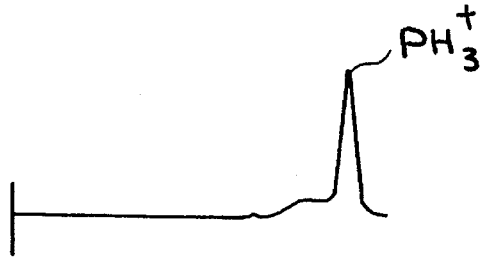
FIG. 3C is a graph of an ion spectrum produced by an ion beam extracted from the inventive plasma ion source operating with a mixture of 5% $PH_3$ and 95% $H_2$ and primary ionizing electron energy limited to 12 eV.

FIGS. 3A, 3B and 3C show mass spectrometer output signals obtained from an 180-degree magnetic deflection spectrometer. The mass spectrum shown in FIG. 3A shows the ion species in the extracted beam when $PH_3$ gas diluted 5:95 with $H_2$ was introduced into a multicusp plasma ion source having a 20 mil GE tungsten filament with a discharge voltage of 25 volts and a discharge current of about 1 to 2 amps. Vacuum chamber pressure of $1\times10^{-3}$ Torr was maintained in the ion source chamber 12. Conventional plasma ion sources use discharge voltages up to 95 volts or more. Several ion peaks of significant amplitude can be observed in this spectra corresponding to hydrogen ions, including $H_2^+$, $H_3^+$, and to a lesser extent $H^+$.

The mass spectrum shown in FIG. 3B shows the ion species in the extracted beam when $PH_3$ gas, diluted 5:95 with $H_2$, was introduced into an inventive multicusp plasma ion source, configured as shown in FIG. 1. A GE tungsten filament with discharge voltage of 16 volts relative to the plasma source chamber walls 23 and a discharge current of about 1 amp. provided primary electrons having energy of 16 eV or lower. While 16 eV is larger than the ionization potential of $H^+$, $H^+$ comprises only about 1% of the hydrogen ion contamination. This can be observed in FIG. 3A. Use of a 16 Volt DC arc discharge bias was seen (FIG. 3B) to eliminate the majority of contaminating hydrogen ions. FIG. 3B shows that there was essentially no contamination from hydrogen species. Essentially only phosphine ions were present in the extracted beam.

FIG. 3C shows the mass spectrum obtained from approximately the same experimental configuration as used in FIG. 3B except that the tungsten filament was biased at only 12 eV relative to the plasma source chamber walls so that the primary electron energy was maintained at 12 eV or lower. The added benefit of using a primary plasma electron source that provide electrons of 12 eV or less is that no water or carbon oxide ions are generated.

The inventive ion source is useful to produce $Xe^+$, $Kr^+$, $Ar^+$, $Ne^+$, $Cs^+$, $F^+$, Cl+, and $Br^+$ ions. Ions from essentially all the elements in the periodic table can be produced with the inventive ion source and contaminating ions with ionization potentials higher than the target ion species will be eliminated.

f. Example 1.

Figure 4:
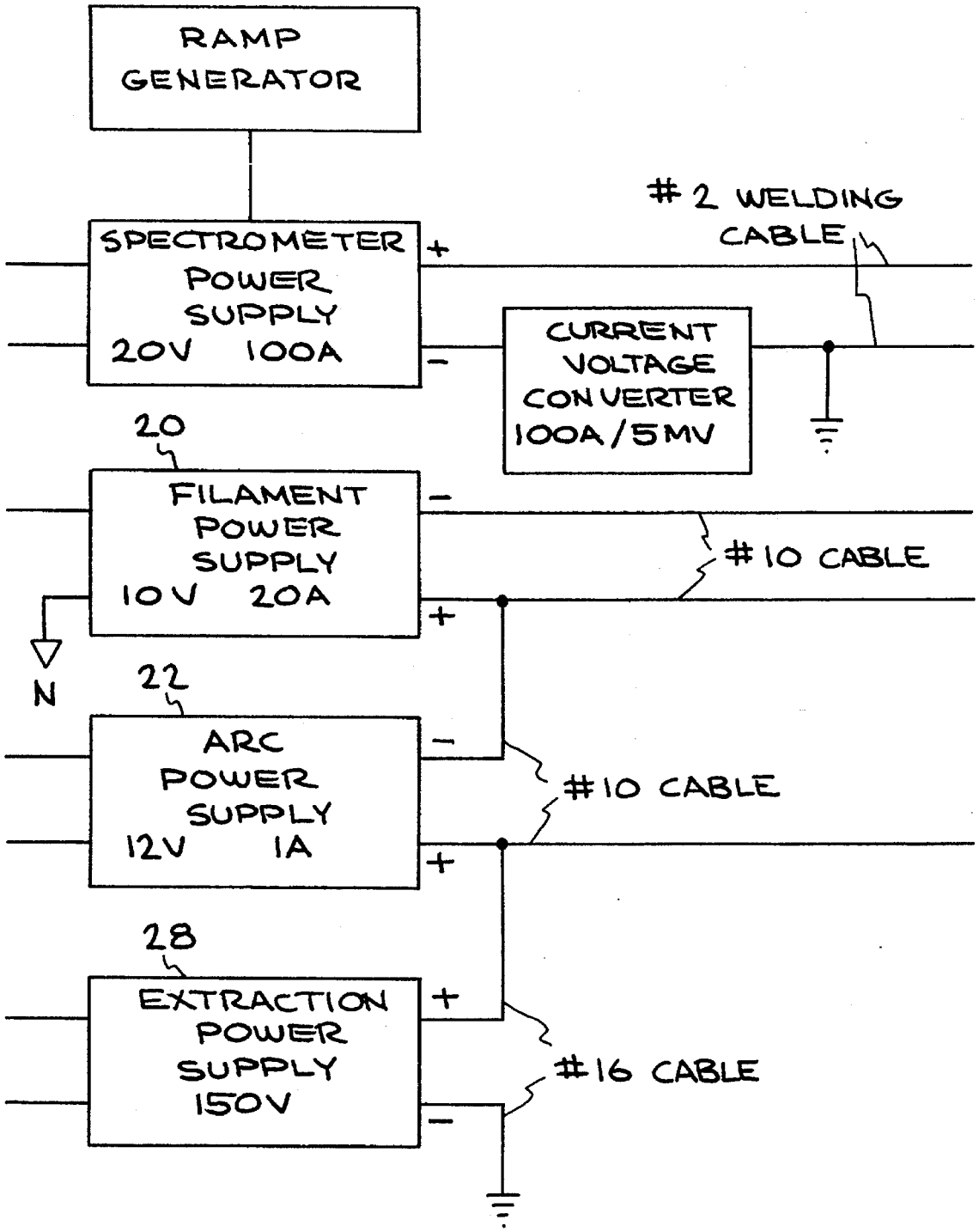
FIG. 4 shows a schematic diagram of the power supply hookups for the configuration illustrated in FIG. 1.

To further illustrate the invention, a multicusp plasma generator (U.S. Pat. No. 5,198,677), with a 7.5 cm diameter was used as an ion source (FIG. 1). Any size plasma chamber can be used and generators capable of producing large volumes of uniform and quiescent plasma have also been shown effective. Phosphine gas diluted 5:95 with hydrogen gas was introduced into the plasma chamber via gas inlet 16. A General Electric 20 mil tungsten-filament electron source 18 was used with a Power Ten DC power supply 20. It was set at about 10 volts and 20 amp to heat the filament. The settings of the power supply 20 are not critical and voltage can vary from a few volts to 20 volts and current can vary up to 30 amps or more. At higher powers unacceptably high levels of impurities may boil off the filament or the filament may burn out. A Power Ten DC power supply 22 was set at either about 12 volts or about 16 volts and about 1 amp. Ions of the target specie were extracted from the plasma chamber by grounding the extractor electrode 29 and biasing the plasma chamber wall at about 150 volts positive with respect to ground using a Power Ten DC power supply 28. The plasma chamber 12 was electrically insulated from the extraction electrode 24. Extractor electrode 24 was allowed to float a few volts above the potential of the plasma. FIG. 4 shows a schematic diagram of the power supply hook-ups. The extracted beam was analyzed using a mass spectrometer (FIGS. 3A, 3B, and 3C).

Instead of extracting ions for implantation, the implant target can be placed inside the plasma chamber and biased to accelerate ions into it, as described in pending application Ser. No. 08/225,043, *Pulsed Source Ion Implantation Apparatus & Method*, incorporated herein by reference.

g. Example 2.

A plasma cathode can be used in place of the tungsten DC arc discharge cathode (FIG. 2). The ion source is comprised of two subassemblies: a magnetic multicusp plasma cathode 30 and a large diameter multicusp plasma ion source 10'. Phosphine gas diluted 5:95 with hydrogen gas is introduced into the plasma chamber via gas inlet 16. The diluted gas diffuses to fill both the plasma chamber and the plasma cathode. In order to maintain a clean source plasma, the ionizing electrons are extracted from a plasma cathode. The plasma in the plasma cathode is produced by an RF induction discharge. A water-cooled, porcelain-coated antenna 32 maintains a clean plasma and is long lasting compared to a tungsten filament. The high energy ionizing electrons of the plasma cathode are generated in a small area inside the helix of the antenna. For the most part, the plasma cathode is filled with low energy electrons having about 2 eV energy. To extract ionizing electrons from the plasma cathode 30 to the plasma chamber 12', a small two-grid extractor is biased at 12 volts between the plasma cathode chamber walls 34 and plasma source chamber walls 23 with power supply 42. The voltage applied by power supply 42 limits the maximum energy of primary ionizing electrons in the plasma chamber 12'.

The present invention provides a way to selectively ionize target species of a compound gas so that the target ion specie can be extracted and/or implanted in a substrate.

The description of illustrative embodiments and best modes of the present invention is not intended to limit the scope of the invention. Various modifications, alternative constructions and equivalents may be employed without departing from the true spirit and scope of the appended claims.

Having thus described the invention, what is claimed is:

1. An ion source comprising a) a plasma chamber;

b) means for generating primary ionizing electrons within the chamber;

c) means for introducing into the chamber a gas to be ionized by the primary electrons; and d) means for limiting plasma electron energy to a value between a target ion species' ionization energy and a larger threshold ionization energy of one or more unwanted ion species.

2. The apparatus of claim 1 further comprising means for extracting the target ion specie from the plasma source.

3. The apparatus of claim 1 further comprising a plurality of magnets surrounding the plasma chamber.

4. The apparatus of claim 3 wherein the magnets are arranged in a multicusp configuration.

5. The apparatus of claim 1 further comprising at least one extraction orifice in the plasma chamber and one or more extraction electrodes placed at one end of the chamber.

6. The apparatus of claim 1 further comprising means for implanting the target ion specie into a target located within the plasma chamber.

7. The apparatus of claim 1 wherein the primary ionizing electron generating means comprises a DC discharge cathode.

8. The apparatus of claim 7 wherein the DC discharge cathode is selected from one of a glow discharge, arc discharge, or photocathode electron source.

9. The apparatus of claim 1 wherein the primary ionizing electron generating means comprises AC electron discharge means.

10. The apparatus of claim 9 wherein the AC electron discharge means is selected from one of an RF energy source, an electron cyclotron resonance source, a microwave energy source, a low-frequency energy source, or laser-driven electron source.

11. The apparatus of claim 10 wherein the frequency range of the AC electron discharge means is between about 0.5 kHz and about 100 MHz.

12. The apparatus of claim 11 wherein the frequency range of the AC electron discharge means is about 2 MHz.

13. The apparatus of claim 9 wherein energy from the AC electron discharge means is inductively or capacitively coupled to the gas.

14. The apparatus of claim 1 wherein the plasma gas is selected from at least one of the group consisting of phosphine, diborane, arsine, hydrogen, and helium.

15. The apparatus of claim 1 wherein the means for limiting primary ionizing electron energy is selected from one of a voltage source, a power supply, or a battery.

16. The apparatus of claim 15 wherein the power supply or voltage supply limits primary ionizing electron energy to between about 2 eV and about 16 eV.

17. The apparatus of claim 16 wherein the power supply or voltage supply limits plasma electron energy to between about 2 eV and about 12 eV.

18. The apparatus of claim 17 wherein the power supply or voltage supply limits plasma electron energy to between about 2 eV and about 10 eV.

19. The apparatus of claim 1 wherein the means for generating ionizing electrons comprises a plasma cathode.

20. The apparatus of claim 19 wherein the plasma cathode is surrounded by a plurality of magnets.

21. The apparatus of claim 20 wherein the plasma cathode magnets are arranged in a multicusp configuration.

22. The apparatus of claim 19 wherein the plasma cathode is located adjacent to the plasma chamber and a small two grid extractor draws electrons from the cathode into the plasma chamber.

23. The apparatus of claim 22 wherein a voltage applied to the extractor limits the ionizing electron energy.

24. The apparatus of claim 23 wherein a voltage applied to the extractor limits the ionizing electron energy to between 2 eV and 16 eV.

25. The apparatus of claim 23 wherein a voltage applied to the extractor limits the ionizing electron energy to between 2 eV and 12 eV.

26. The apparatus of claim 22 wherein the plasma cathode contains a magnetic filter located near the plasma cathode extractor.

27. A method of selectively ionizing target species in a plasma source which comprises limiting ionizing electron energy to a value between approximately the threshold ionization potential of the target specie and approximately the threshold ionization potential of unwanted species.

* * * * *